United States Patent [19]

Lemense

[11] Patent Number: 4,907,569

[45] Date of Patent: Mar. 13, 1990

[54] WATER HEATER WITH SKIRT RING DAM

[75] Inventor: Rodney A. Lemense, Hartland, Wis.

[73] Assignee: A.O. Smith Corporation, Milwaukee, Wis.

[21] Appl. No.: 293,681

[22] Filed: Jan. 5, 1989

[51] Int. Cl.[4] ..... F24H 1/00; B65D 25/18

[52] U.S. Cl. ..... 126/373; 126/350 R; 220/444; 220/445; 220/447; 220/67; 220/68; 220/431

[58] Field of Search ..... 126/373, 350; 220/444, 220/445, 447, 430, 431, 432, 433, 68, 70, 67

[56] References Cited

U.S. PATENT DOCUMENTS

| | | | |
|---|---|---|---|
| 3,012,958 | 12/1961 | Vixler | 220/431 X |
| 3,253,731 | 5/1966 | Fink et al. . | |
| 3,378,162 | 4/1968 | Smith | 220/430 X |
| 4,303,190 | 12/1981 | Ditto et al. | 220/68 X |
| 4,372,028 | 2/1983 | Clark et al. . | |
| 4,447,377 | 5/1984 | Denton . | |
| 4,477,399 | 10/1984 | Tilton . | |
| 4,527,543 | 7/1985 | Denton . | |
| 4,628,184 | 12/1986 | West . | |
| 4,632,792 | 12/1986 | Clark . | |
| 4,736,509 | 4/1988 | Nelson . | |
| 4,744,488 | 5/1988 | Nelson . | |
| 4,749,532 | 6/1988 | Pfeffer . | |
| 4,790,290 | 12/1988 | Chevalier et al. . | |

*Primary Examiner*—Larry Jones

*Attorney, Agent, or Firm*—Andrus, Sceales, Starke & Sawall

[57] ABSTRACT

A hot water heater (40) has an inner storage tank (2), a lower skirt ring (42, 60, 74, 84, 110, 116) supporting and spacing the tank above a support surface (10*a*), and an outer jacket (46, 66, 80, 90, 98, 104, 122) around the inner storage tank and spaced outwardly therefrom to define an annular cavity space (22) therebetween. The skirt ring mates with the outer jacket and forms a dam sealing the annular space. Foamed insulation introduced as a liquid into the annular space hardens to form an annular insulation layer (13) around the inner storage tank. The dam prevents leakage of liquid therepast. Inwardly and outwardly extending skirt ring flanges (44, 62, 78, 88, 114, 120) are disclosed, together with various outer jacket constructions (46, 66, 80, 90, 98, 104, 122), including turned lower end flanges (52, 102, 108), and straight lower ends (68, 81, 92, 126).

15 Claims, 4 Drawing Sheets

FIG. 3
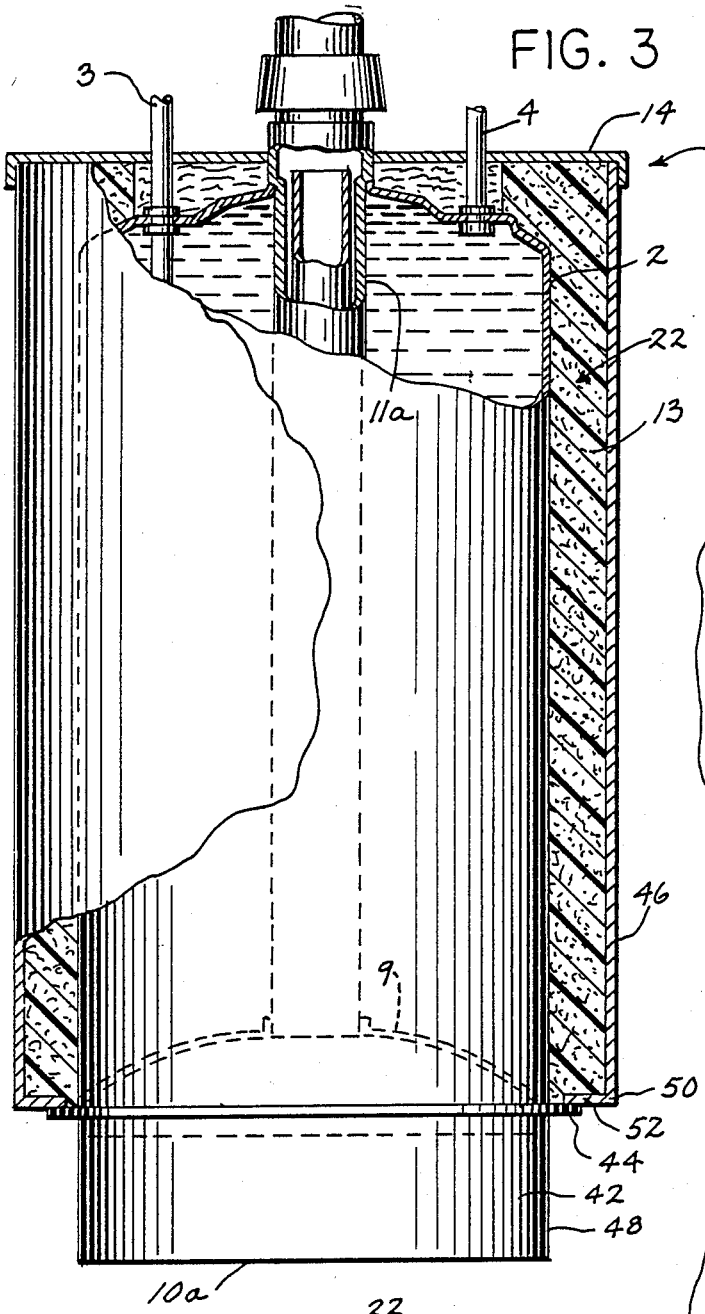
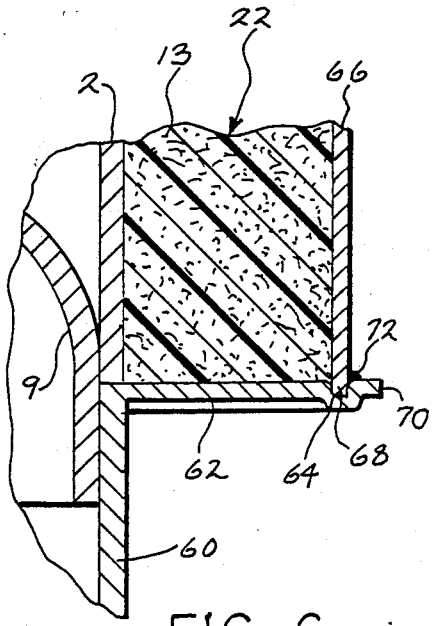
FIG. 6
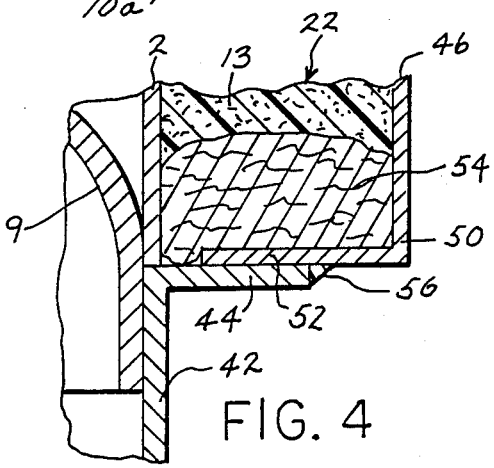
FIG. 4
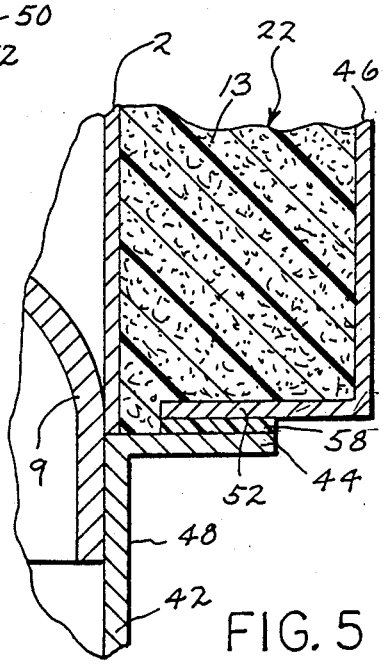
FIG. 5

FIG. 12
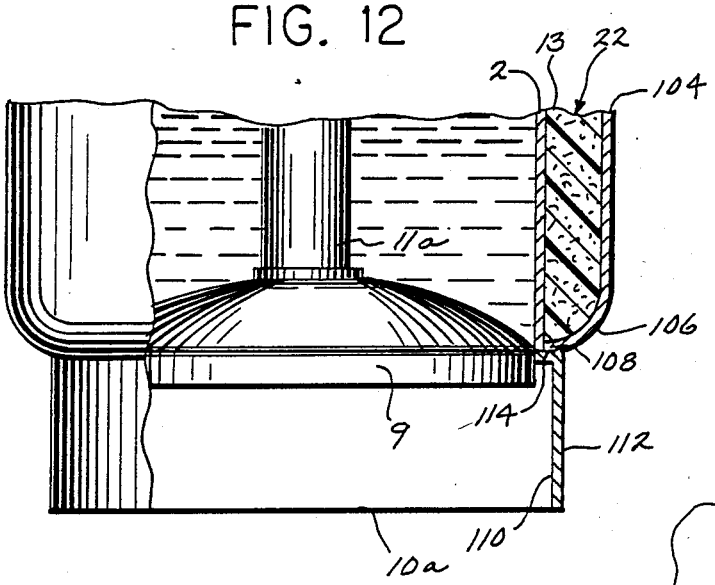
FIG.13
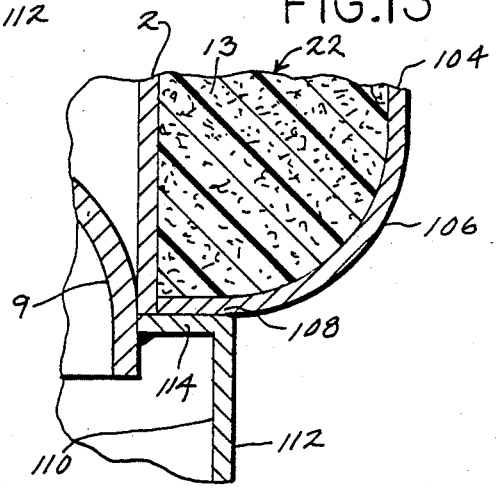
FIG.14
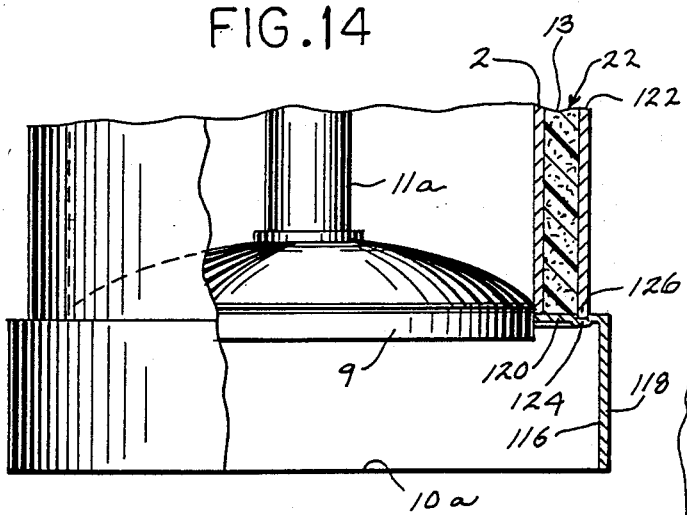
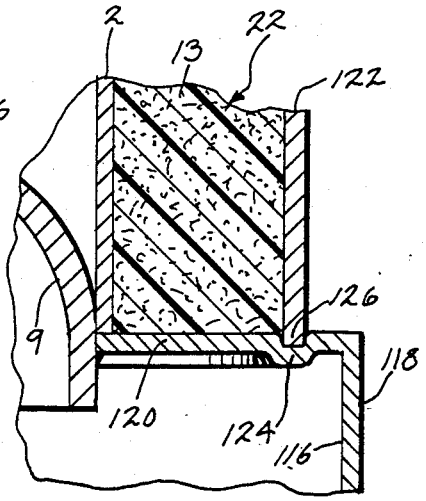
FIG. 15

WATER HEATER WITH SKIRT RING DAM

BACKGROUND AND SUMMARY

The invention relates to insulated fluid storage units, including hot water heaters.

Hot water heaters for domestic and other applications include an inner storage tank having an associated heating unit for heating water in the tank. The tank is enclosed with suitable insulation to retain the heat and minimize the necessity for frequent reheating. An outer asthetically pleasing jacket or shell is provided to enclose the insulation.

A highly satisfactory insulating material is expandable foamed insulation such as expanding foamed polyurethane. The insulation is applied in a fluid state into the annular cavity space between the inner storage tank and the outer jacket and foams and expands to produce a rigid and closely adhereing insulating enclosure about the inner tank.

Gas water heaters are provided with a burner aligned with the bottom of the storage tank. A skirt ring supports and spaces the tank above a support surface or base and defines a firing chamber. Polyurethane produces toxic fumes when burned, and hence must be protected from the temperature and flame of the heating unit. Various isolation sealing dams have been devised to deal with this problem, such as an inflatable donut bag, Clark et al U.S. Pat. No. 4,372,028, Tilton U.S. Pat. No. 4,477,399, a fiberglass collar, Pfeffer U.S. Pat. No. 4,749,532, Nelson U.S. Pat. No. 4,736,509, and an envelope bag, Denton U.S. Pat. Nos. 4,447,377, 4,527,543.

The present invention provides an improved dam which is simple and cost effective in manufacture.

BRIEF DESCRIPTION OF THE DRAWINGS

Prior Art

Present Invention

FIG. 3 is a side elevation view of a hot water heater, partially broken away, in accordance with the invention.

FIG. 4 is an enlarged view of a portion of FIG. 3.

FIG. 5 is a view like FIG. 4, and shows an alternate embodiment.

FIG. 6 is a view like FIG. 4, and shows an alternate embodiment.

Figure 7:
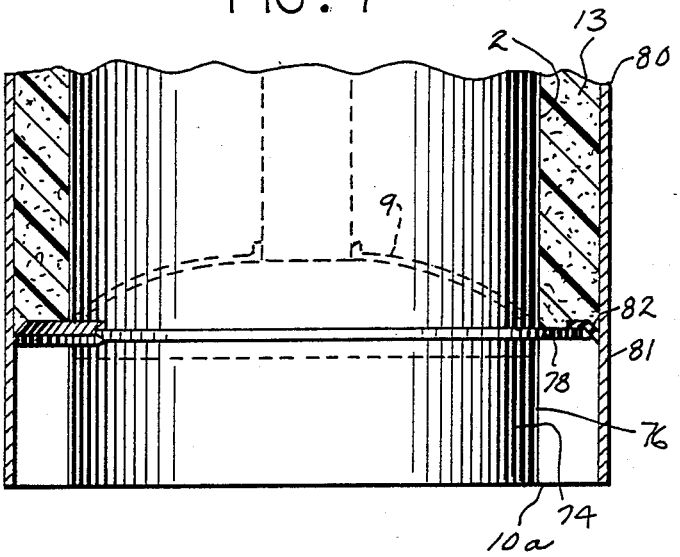

FIG. 7 is a view like a portion of FIG. 3, and shows an alternate embodiment.

Figure 8:
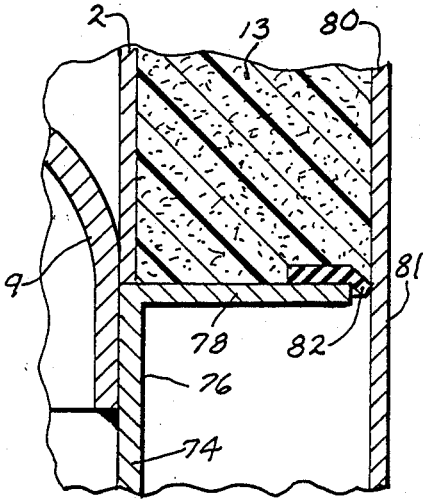

FIG. 8 is an enlarged view of a portion of FIG. 7.

Figure 9:
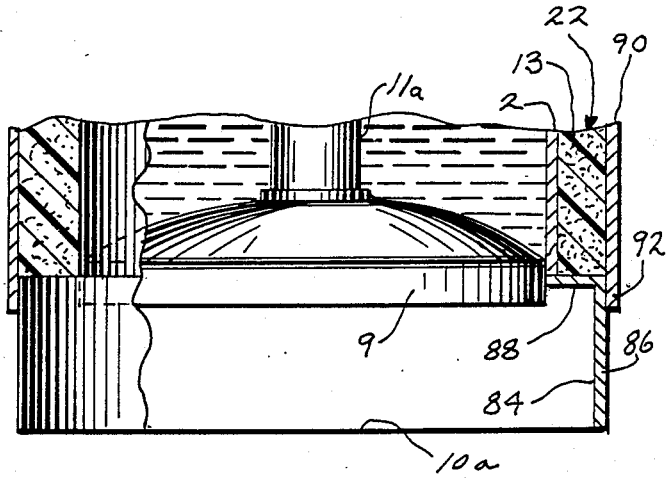

FIG. 9 is a view like a portion of FIG. 3, and shows an alternate embodiment.

Figure 10:
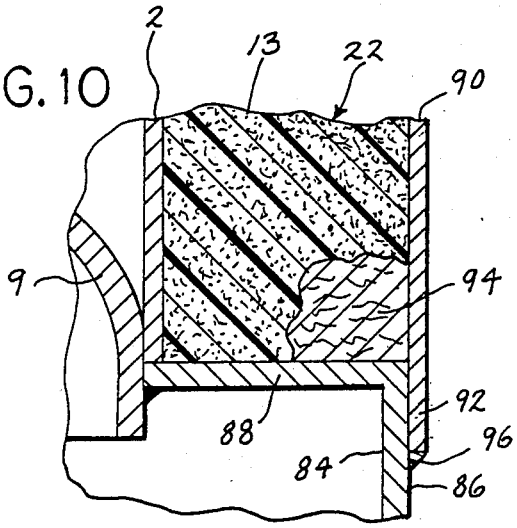

FIG. 10 is an enlarged view of a portion of FIG. 9.

Figure 11:
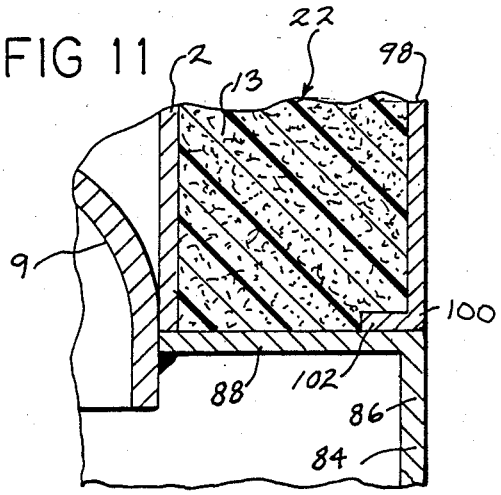

FIG. 11 is a view like FIG. 10 and shows an alternate embodiment.

FIG. 12 is a view like a portion of FIG. 3, and shows an alternate embodiment.

FIG. 13 is an enlarged view of a portion of FIG. 12.

FIG. 14 is a view like a portion of FIG. 3, and shows an alternate embodiment.

FIG. 15 is an enlarged view of a portion of FIG. 14.

DETAILED DESCRIPTION

Prior Art

Figure 1:
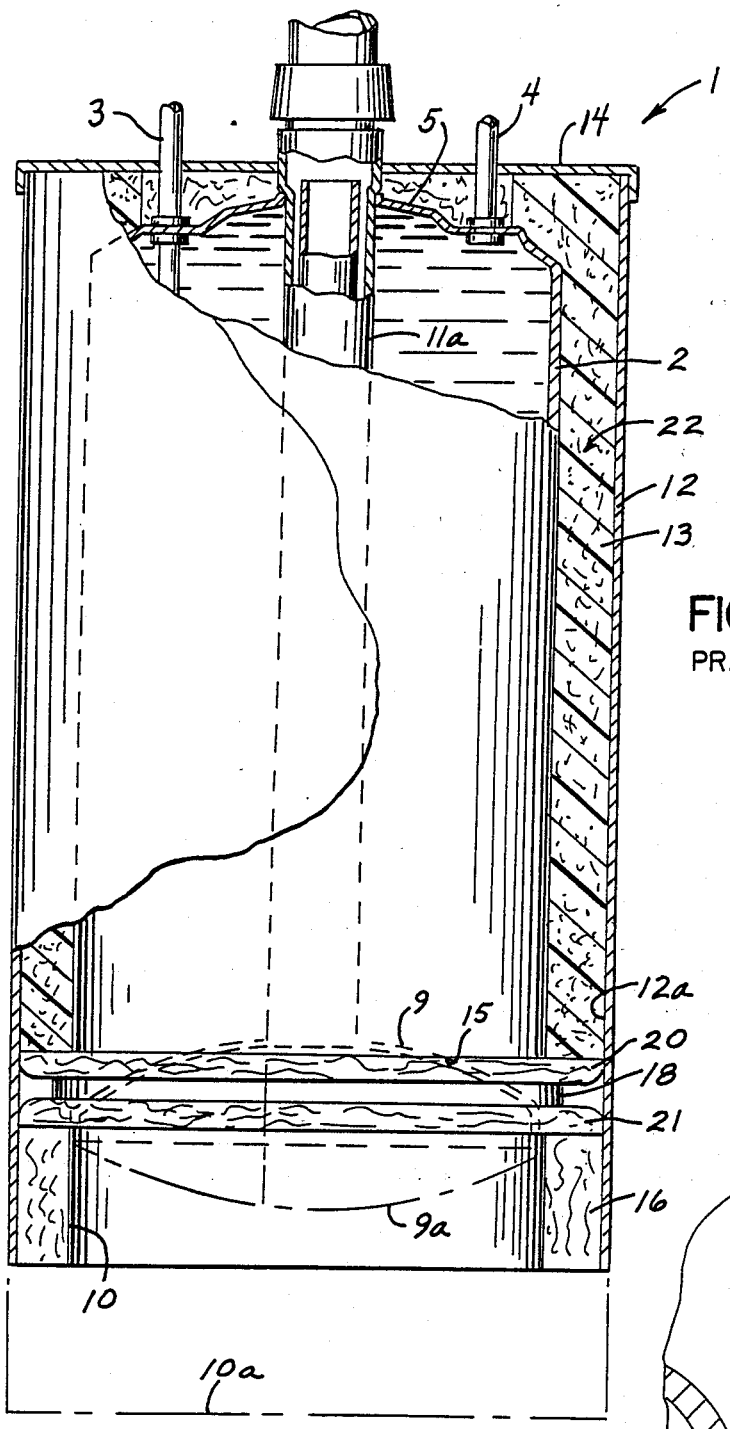
FIG. 1 PRIOR ART
FIG. 1 is a side elevation view of a hot water heater, partially broken away, known in the prior art.
Figure 2:
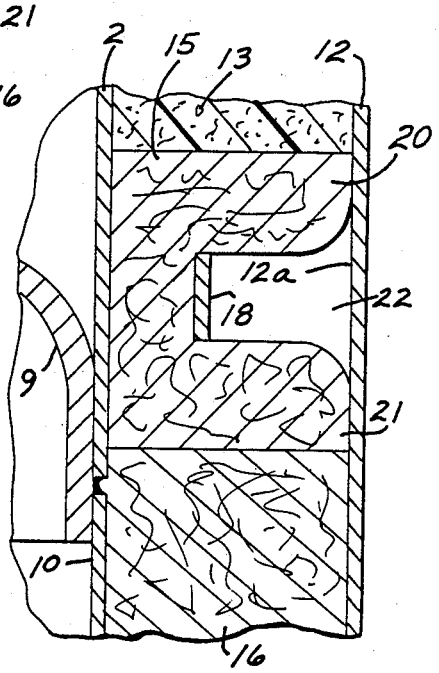
FIG. 2 PRIOR ART
FIG. 2 is an enlarged view of a portion of FIG. 1.

FIGS. 1 and 2 show a hot water heater 1 known in the prior art, for example as shown in Pfeffer U.S. Pat. No. 4,749,532, incorporated herein by reference. FIGS. 1 and 2 use like reference numerals from the incorporated Pfeffer patent where appropriate to facilitate clarity. Inner steel storage tank 2 has water inlet and outlet connections 3 and 4 at domed top wall 5. Tank 2 may have a concave bottom wall as shown in dashed line at 9, and as shown in the incorporated Pfeffer patent, or may have a convex bottom wall as shown in dashed line at 9*a*. Lower annular steel skirt ring 10 is welded to tank 2 and supports and spaces tank 2 above a support surface or base shown in dashed line at 10*a*. The full vertical height of skirt ring 10 is not shown, and will vary depending upon application. Skirt ring 10 defines a fire box or chamber within which is mounted the heater unit, for example as shown at 11 in FIG. 2 of the incorporated Pfeffer patent. Skirt ring 10 may rest directly on the floor and have cut-outs therein to supply combustion air to the fire box chamber, or the support surface or base 10*a* may have cut-outs therein and be supported above the floor by legs (not shown). Flue duct 11*a* is mounted centrally of tank 2 and extends upwardly beyond top tank wall 5 for exhausting waste gases of combustion. The inner surface of tank 2, as well as the outer surface of flue 11*a*, can be coated with a conventional corrosion resistant coating (not shown) such as glass or vitreous enamel.

An outer asthetically pleasing jacket or shell 12 formed of relatively thin metal is spaced outwardly of inner tank 2 to define an annular cavity space 22 therebetween. Foamed insulation 13 is introduced as a liquid into annular space 22 and hardens to form an annular insulation layer around inner storage tank 2, for which further reference may be had to the incorporated Pfeffer patent, including FIG. 7 thereof. Insulation 13 extends upwardly over top wall 5 of tank 2. A jacket cover 14 is secured to the top of jacket 12 and maintains an asthetically pleasing outer enclosure and defines an upper space which is filled with insulation 13. The lower end of insulation 13 is defined by an encircling fiberglass belt 15 providing a dam blocking passage of liquid therepast during the foaming insulation process. The dam isolates insulation 13 from the heater unit below the tank. Belt 15 is wrapped around the tank and held thereto by an encircling cinch band 18 tightened to cause the upper and lower ends 20 and 21 of belt 15 to bulge or flare outwardly to fill the gap to the inner wall 12*a* of outer jacket 12, to provide the noted dam. Another fiberglass belt 16 may encircle skirt ring 10 below belt 15, for further insulation.

PRESENT INVENTION

FIG. 3 shows an insulated fluid storage unit 40 in accordance with the invention, and uses like reference numerals from FIG. 1 where appropriate to facilitate clarity. Inner storage tank 2 is supported and spaced above support surface 10*a* by lower skirt ring 42 which is similar to lower skirt ring 10 but has an upper ledge portion 44 mating with outer jacket 46 and forming a dam preventing leakage of liquid therepast and sealing the lower end of annular cavity space 22 when foamed insulation is introduced as a liquid into such space and hardens to form an annular insulation layer around inner storage tank 2. Skirt ring 44 includes an annular vertical sidewall 48 extending upwardly from support surface 10a, and additionally includes the noted upper portion 44 formed by a flange extending radially from sidewall 48 to mate with outer jacket 46. Sidewall 48 has a diameter substantially the same as inner storage tank 2. Outer jacket 46 has a lower end 50 with a radially inwardly extending flange 52 overlapping at least a portion of radially outwardly extending flange 44 of skirt ring 42 and forming the noted dam.

In FIG. 3, outer jacket flange 52 rests directly on and engages skirt ring flange 44. For most viscosities of the foaming polyurethane liquid resin, this direct engagement is found to provide a sufficient seal. If further or additional sealing is desired in applications involving higher viscosity fluids or otherwise having additional requirements, further sealing may be provided. As shown in FIG. 4, the lower end of annular cavity space 22 may be further sealed by sealing the interface between flanges 52 and 44, for example by a layer of fiberglass 54 at the bottom of annular cavity space 22 and/or by an external sealer 56 such as caulk, putty, tape, fiberglass batt, or any other suitable material for sealing such interface. In an alternative as shown in FIG. 5, flange 52 extends above flange 44, and the noted sealing is provided by a gasket 58, such as fiberglass, or any other suitable material, between the flanges.

In the embodiment shown in FIG. 6, lower skirt ring 60 has a flange 62 extending radially outwardly therefrom and having an annular notch 64 therein. Outer jacket 66 has a lower end 68 received in annular notch 64. Outer jacket 66 has a diameter substantially the same as that of annular notch 64. Flange 62 of skirt ring 60 extends radially outwardly at outer tip 70 beyond outer jacket 66. Sealer 72, such as caulk, putty, tape, fiberglass, or any other suitable material, may be added if desired to further seal the interface between lower end 68 of outer jacket 66 and flange 62 at annular notch 64.

In FIG. 7, lower skirt ring 74 has a sidewall 76 extending upwardly from support surface 10a, and a flange 78 extending radially outwardly from sidewall 76. Outer jacket 80 extends downwardly at 81 past flange 78 of skirt ring 74. Flange 78 mates with outer jacket 80 and forms the noted dam. The skirt ring may directly engage the outer jacket, or an additional sealing element such as flexible member 82, FIG. 8, may be provided for sealing the interface therebetween. Outer jacket is slid downwardly around inner storage tank 2 past flange 78, unlike the structure in FIGS. 3–6 wherein the jacket is slid downwardly around tank 2 until the lower end of the jacket engages and is stopped by the skirt ring flange.

In FIG. 9, lower skirt ring 84 has an annular vertical sidewall 86 extending upwardly from support surface 10a, and an annular flange 88 extending radially inwardly from sidewall 86 to engage and support inner storage tank 2. The inner end of flange 88 is welded to tank bottom 9. Annular sidewall 86 of the skirt ring has a diameter greater than that of inner storage tank 2 and substantially the same as that of outer jacket 90. Outer jacket 90 mates with skirt ring 84 to form the noted dam sealing the lower end of annular cavity space 22. Outer jacket 90 has a lower end 92 extending downwardly along the outside of sidewall 86 of the skirt ring, preferably with a moderately tight interference fit. The lower end of annular space 22 may be further sealed by sealing the interface between lower end 92 and the skirt ring, for example by fiberglass material 94, FIG. 10, at the bottom of annular space 22, and/or by an external sealer 96 such as caulk, putty, tape, fiberglass, or any other suitable material for sealing such interface.

In FIG. 11, outer jacket 98 has a lower end 100 with a radially inwardly extending flange 102 overlapping at least a portion of radially inwardly extending flange 88 of skirt ring 84 to form the noted dam. Flange 102 rests directly on flange 88. Sealing material may be provided at the edges of such interface, as in FIG. 4, to provide further sealing. Alternatively, a gasket may be provided between flanges 102 and 88, as in FIG. 5.

In FIGS. 12 and 13, outer jacket 104 has a lower end 106 with a radially inwardly extending flange 108 having an inner diameter substantially the same as that of tank 2, to engage tank 2 and provide further sealing of the lower end of annular cavity space 22. FIGS. 12 and 13 show the lower flange 108 curving inwardly along a rounded curve from outer jacket 104. Alternatively, lower flange 108 may extend inwardly at a right angle to the outer jacket, as in prior figures. In FIGS. 12 and 13, lower skirt ring 110 has an annular vertical sidewall 112 extending upwardly from support surface 10a, and an annular flange 114 extending radially inwardly from sidewall 112 to engage and support inner tank 2, as in FIGS. 9–11. Sidewall 112 has a diameter less than that of the outer diameter of outer jacket 104, and greater than that of tank 2. As before, further sealing of the lower end of annular space 22 may be provided if desired by sealing material at the edge of the interface of the flanges, internally or externally to annular space 22, or by a gasket between the flanges, all as above.

In FIGS. 14 and 15, lower skirt ring 116 has an annular vertical sidewall 118 extending upwardly from support surface 10a, and an annular flange 120 extending radially inwardly from sidewall 118 to engage and support tank 2, as in FIGS. 9–13. Sidewall 118 has a diameter greater than that of the outer diameter of outer jacket 122. Skirt ring flange 120 has an annular notch 124 therein. Outer jacket 122 has a lower end 126 received in annular notch 124 and forming the noted dam. Sealing material may be provided at the edge of the interface, as above, if desired.

Though a concave bottom wall 9 of the tank is shown, the invention is equally applicable to tanks having a convex bottom wall which bows toward support surface 10a, for example as shown at 9a in FIG. 1.

It is recognized that various equivalents, alternatives and modifications are possible within the scope of the appended claims.

I claim:

1. An insulated fluid storage unit comprising:

an inner storage tank;

a lower skirt ring supporting and spacing said inner storage tank above a support surface, said skirt ring comprising a sidewall extending upwardly from said support surface and a flange extending radially outwardly from said sidewall;

an outer jacket around said inner storage tank and spaced outwardly therefrom to define an annular space therebetween, said outer jacket having a lower end with a radially inwardly extending flange overlapping at least a portion of said radially outwardly extending flange of said skirt ring and mating therewith to form a dam sealing said annular space;

foamed insulation introduced as a liquid into said annular space and hardening to form an annular insulation layer around said inner storage tank, said dam preventing leakage of said liquid therepast;

sealing means sealing the interface between said flanges, to provide further sealing of said dam in said annular space.

2. The invention according to claim 1 wherein said sealing means comprises sealing material at the edge of said interface between said flanges.

3. The invention according to claim 1 wherein said sealing means comprises a gasket between said flanges.

4. An insulated fluid storage unit comprising:

an inner storage tank;

a lower skirt ring supporting and spacing said inner storage tank above a support surface, said skirt ring comprising a sidewall extending upwardly from said support surface and a flange extending radially outwardly from said sidewall;

an outer jacket around said inner storage tank and spaced outwardly therefrom to define an annular space therebetween, said outer jacket having a lower end with a radially inwardly extending flange overlapping at least a portion of said radially outwardly extending flange of said skirt ring and mating therewith to form a dam sealing said annular space;

foamed insulation introduced as a liquid into said annular space and hardening to form an annular insulation layer around said inner storage tank, said dam preventing leakage of said liquid therepast, wherein said inwardly extending flange at said lower end of said jacket has an inner diameter substantially the same as the outer diameter of said inner storage tank.

5. An insulated fluid storage unit comprising:

an inner storage tank;

a lower skirt ring supporting and spacing said inner storage tank above a support surface, said skirt ring comprising a sidewall extending upwardly from said support surface and a flange extending radially outwardly from said sidewall;

an outer jacket around said inner storage tank and spaced outwardly therefrom to define an annular space therebetween, said outer jacket having a lower end with a radially inwardly extending flange overlapping at least a portion of said radially outwardly extending flange of said skirt ring and mating therewith to form a dam sealing said annular space;

foamed insulation introduced as a liquid into said annular space and hardening to form an annular insulation layer around said inner storage tank, said dam preventing leakage of said liquid therepast, wherein said sidewall of said skirt ring is annular and has a diameter substantially the same as said inner storage tank, and wherein said outer jacket has an outer diameter greater than the diameter at the outer edge of said radially outwardly extending flange of said skirt ring.

6. An insulated fluid storage unit comprising:

an inner storage tank;

a lower skirt ring supporting and spacing said inner storage tank above a support surface, said skirt ring comprising a sidewall extending upwardly from said support surface, and a flange extending radially outwardly from said sidewall, said flange having an annular notch therein;

an outer jacket around said inner storage tank and spaced outwardly therefrom to define an annular space therebetween, said outer jacket having a lower end received in said annular notch in said flange of said skirt ring and mating therewith to form a dam sealing said annular space;

foamed insulation introduced as a liquid into said annular space and hardening to form an annular insulation layer around said inner storage tank, said dam preventing leakage of said liquid therepast, wherein said outer jacket has a diameter substantially the same as that of said annular notch, and comprising sealing means sealing the interface between said lower end of said outer jacket and said flange of said skirt ring at said annular notch.

7. An insulated fluid storage unit comprising:

an inner storage tank;

a lower skirt ring supporting and spacing said inner storage tank above a support surface, said skirt ring comprising a sidewall extending upwardly from said support surface, and a flange extending radially from said sidewall;

an outer jacket around said inner storage tank and spaced outwardly therefrom to define an annular space therebetween, said outer jacket extending downwardly past said flange of said skirt ring and mating with said skirt ring to form a dam sealing said annular space;

foamed insulation introduced as a liquid into said annular space and hardening to form an annular insulation layer around said inner storage tank, said dam preventing leakage of said liquid therepast, wherein said flange of said skirt ring extends radially outwardly from said sidewall and mates with said outer jacket extending therepast to form said dam, and comprising sealing means sealing the interface between said flange and said outer jacket.

8. An insulated fluid storage unit comprising:

an inner storage tank;

a lower skirt ring supporting and spacing said inner storage tank above a support surface, said skirt ring comprising an annular sidewall extending upwardly from said support surface, and an annular flange extending radially inwardly from said sidewall to engage and support said inner storage tank, said annular sidewall of said skirt ring having a diameter greater than said inner storage tank;

an outer jacket around said inner storage tank and spaced outwardly therefrom to define an annular space therebetween and mating with said skirt ring to form a dam sealing said annular space;

foamed insulation introduced as a liquid into said annular space and hardening to form an annular insulation layer around said inner storage tank, said dam preventing leakage of said liquid therepast, wherein said outer jacket has a lower end extending downwardly along the outside of said sidewall of said skirt ring, and comprising sealing means sealing the interface between said outer jacket and said skirt ring, providing further sealing of said dam in said annular space.

9. An insulated fluid storage unit comprising:

an inner storage tank;

a lower skirt ring supporting and spacing said inner storage tank above a support surface, said skirt ring comprising an annular sidewall extending upwardly from said support surface, and an annular flange extending radially inwardly from said sidewall to engage and support said inner storage tank, said annular sidewall of said skirt ring having a diameter greater than said inner storage tank;

an outer jacket around said inner storage tank and spaced outwardly therefrom to define an annular space therebetween and mating with said skirt ring to form a dam sealing said annular space;

foamed insulation introduced as a liquid into said annular space and hardening to form an annular insulation layer around said inner storage tank, said dam preventing leakage of said liquid therepast, wherein said outer jacket has a lower end mating with said inwardly extending flange of said skirt ring to form said dam.

10. The invention according to claim 9 comprising sealing means sealing the interface between said outer jacket and said skirt ring flange, providing further sealing of said dam in said annular space.

11. An insulated fluid storage unit comprising:

an inner storage tank;

a lower skirt ring supporting and spacing said inner storage tank above a support surface, said skirt ring comprising an annular sidewall extending upwardly from said support surface, and an annular flange extending radially inwardly from said sidewall to engage and support said inner tank, said annular sidewall of said skirt ring having a diameter greater than said inner store tank;

an outer jacket around said inner storage tank and spaced outwardly therefrom to define an annular space therebetween, said outer jacket having a radially inwardly extending flange overlapping at least a portion of said radially inwardly extending flange of said skirt ring and mating therewith to form a dam sealing said annular space;

foamed insulation introduced as a liquid into said annular space and hardening to form an annular insulation layer around said inner storage tank, said dam preventing leakage of said liquid therepast;

sealing means sealing the interface between said flanges, to provide further sealing of said dam in said annular space.

12. The invention according to claim 11 wherein said sealing means comprises sealing material at the edge of the interface between said flanges.

13. The invention according to claim 11 wherein said sealing means comprises a gasket between said flanges.

14. An insulated fluid storage unit comprising:

an inner storage tank;

a lower skirt ring supporting and spacing said inner storage tank above a support surface, said skirt ring comprising an annular sidewall extending upwardly from said support surface and having a diameter greater than said inner storage tank, and an annular flange extending radially inwardly from said sidewall to engage and support said inner storage tank, said inwardly extending flange having an annular notch therein;

an outer jacket around said inner storage tank and spaced outwardly therefrom to define an annular space therebetween, said jacket having a lower end received in said annular notch of said skirt ring and mating therewith to form a dam sealing said annular space;

foamed insulation introduced as a liquid into said annular space and hardening to form an annular insulation layer aorund said inner storage tank, said dam preventing leakage of said liquid therepast, wherein said outer jacket has a diameter substantially the same as the diameter of said annular notch, and sealing means sealing the interface between said skirt ring and said outer jacket in said annular notch, to provide further sealing of said dam in said annular space.

15. An insulated fluid storage unit comprising:

an inner storage tank;

a lower skirt ring supporting and spacing said inner storage tank above a support surface, said skirt ring comprising a sidewall extending upwardly from said support surface and a flange extending radially outwardly from said sidewall;

an outer jacket around said inner storage tank and spaced outwardly therefrom to define an annular space therebetween, said outer jacket having a lower end with a radially inwardly extending flange overlapping at least a portion of said radially outwardly extending flange of said skirt ring and mating therewith to form a dam sealing said annular space;

foamed insulation introduced as a liquid into said annular space and hardening to form an annular insulation layer around said inner storage tank, said dam preventing leakage of said liquid therepast, wherein said inwardly extending flange at said lower end of said jacket has an inner diameter less than the outer diameter of said inner storage tank.

* * * * *